US005147067A

United States Patent [19]

Effertz

[11] Patent Number: 5,147,067

[45] Date of Patent: Sep. 15, 1992

[54] INSULATED JACKET FOR BEVERAGE CONTAINER

[75] Inventor: Charles E. Effertz, Wayzata, Minn.

[73] Assignee: EBI, Victoria, Minn.

[21] Appl. No.: 801,382

[22] Filed: Dec. 2, 1991

[51] Int. Cl.[5] ..... B32B 3/26

[52] U.S. Cl. ..... 220/739; 220/903; 294/31.2; 229/87.04

[58] Field of Search ..... 294/150, 31.2; 220/903, 220/739, 737, 741, 94 A, 94 R, 96; 229/87.04, 91; 215/100 A; 62/530, 457.1–457.4

[56] References Cited

U.S. PATENT DOCUMENTS

| | | | |
|---|---|---|---|
| D. 159,535 | 11/1948 | Reineke . | |
| 1,950,505 | 2/1933 | Matters . | |
| 1,999,878 | 4/1935 | La Bombard | 294/31.2 |
| 2,196,529 | 4/1940 | Jenkins | 294/31.2 |
| 2,605,945 | 8/1952 | Dechar | 294/31.2 |
| 2,936,927 | 5/1960 | Peters | 220/737 |
| 3,073,493 | 1/1962 | Pfaffenberger | 220/94 R |
| 3,092,277 | 10/1963 | Brim . | |
| 3,262,283 | 12/1964 | Taylor . | |
| 3,456,840 | 7/1969 | McAlister | 220/741 |
| 4,181,765 | 1/1980 | Harmony . | |
| 4,230,235 | 10/1980 | DiAmico | 220/94 R |
| 4,268,567 | 5/1981 | Harmony . | |
| 4,282,279 | 8/1981 | Strickland . | |
| 4,344,303 | 8/1982 | Kelly, Jr. . | |
| 4,399,668 | 8/1983 | Williamson . | |
| 4,491,356 | 1/1985 | Carr, Jr. | 294/31.2 |
| 4,685,583 | 8/1987 | Noon | 294/31.2 |
| 4,832,398 | 5/1989 | Tecca et al. | 294/31.2 |
| 4,927,047 | 5/1990 | Stuber et al. . | |
| 4,966,303 | 10/1990 | Jones | 220/903 |

*Primary Examiner*—Stephen Marcus
*Assistant Examiner*—S. Castellano
*Attorney, Agent, or Firm*—Schroeder & Siegfried

[57] ABSTRACT

A handled, open-ended, single layer, elastic and resilient thermal insulator for cylindrical beverage containers made in the form of a flat rectangular strip of foamed cross-linked polyolefin which is slightly longer than the circumference of the container to be insulated and has a pair of overlapping inter-engaging tabs at its opposite end portions and integral closed handle elements extending radially outwardly from above and below the tabs when the strip is applied to such a container. The insulator is made by a method in which a generally rectangular strip is cut from a panel of such flexible expanded thermal insulating material and, at the same time, a U-shaped cut is made in the interior of each of the opposite terminal portions of the strip to thereby produce flexible tabs, with the open end of each of the U-shaped cuts facing each other. Cooperative, interlocking engagement members such as Velcro is secured to opposite sides of the two (2) tabs so that when overlapped, they will secure the strip in tight encircling relation to a cylindrical container, thereby causing the end portions of the strip to extend radially outwardly to cooperatively function as closed handle elements.

5 Claims, 2 Drawing Sheets

INSULATED JACKET FOR BEVERAGE CONTAINER

BACKGROUND OF THE INVENTION

The closest prior art known to the inventor herein is believed to be U.S. Pat. No. 4,399,668, which discloses a multi-layered thermal wrap for beverage containers having an inner coolant layer and an outer insulating layer which is externally surrounded by a protective layer. This item is obviously relatively complicated and expensive to manufacture. FIG. 4 shows one version of the invention in which end portions are secured together and provided with openings to function as a handle. FIG. 3 shows overlapping portions secured by Velcro with no handle function provided.

U.S. Pat. No. 4,268,567, shows an insulating wrap for beverage cans in which adhesive is applied to opposite surfaces at its end portions to secure the wrap. No handle members are provided. U.S. Pat. No. 4,181,765 shows the same construction as U.S. Pat. No. 4,268,567.

U.S. Pat. No. 3,092,277, shows a thermal jacket having a cap member and a lower portion comprised of a pair of semi-cylindrical members.

U.S. Pat. No. 4,344,303, shows a beverage container in which a cooling fluid is contained in frozen condition within the insulating strip.

U.S. Pat. No. 4,282,279, shows a multi-layered insulator strip with overlapping end portions.

U.S. Pat. No. 1,950,505, shows a jacket for liquid dispensing receptacles comprised of a flat strip having overlapping end portions with adhesive at each end at the same side so that when they meet and adhere, they form a radially outwardly extending grip.

U.S. Pat. No. 159,535, shows a jacket-type coaster in which the end portions of the jacket meet and are secured together with a ring, while the ends extend radially outwardly to function as a grip.

U.S. Pat. No. 4,927,047, shows an insulating container for canned beverages which is non-collapsible and is made of foamed insulating materials and has separate cover and jacket elements secured in operating position by a single rubber band.

As can be seen from the above, various forms of insulating jackets have been designed in the past. None of these have proved particularly successful and all of them have disadvantages which cause them to function inadequately or involve expensive manufacture. Many of them have relatively large compass and hence require relatively large storage areas and cannot be stacked handily adjacent a cash register or sales point so as to be brought to the attention of the customer. All of them are relatively costly. Thus, there is definite need for a truly inexpensive insulating jacket which will function in an improved way, can be stored and offered for sale in unassembled condition, can be quickly, simply, and easily assembled, and can be disassembled easily for storage and future use. My new insulating jacket overcomes each of the above disadvantages.

BRIEF SUMMARY OF THE INVENTION

I have invented an insulating jacket for beverage cans which is manufactured from a flat panel of insulating material such as cross-linked polyolefin and can be stored and displayed for sale in flat unassembled form. The jacket is comprised of a strip which is about ⅜ inch thick and is generally rectangular in shape. I make an inwardly facing generally U-shaped cut in each end portion to provide a tab which can be swung to either side of the panel as means for securing one such tab to the other when the strip is applied in encircling relation to a beverage can. The strip is slightly narrower than the height of the can so that the latter will extend outwardly therebeyond when the strip is applied to its medial portions.

A small strip of Velcro is adhered to one of the above tabs adjacent its free end (created by the cut) and a second small strip of cooperating Velcro is similarly applied to the other tab at its opposite side so that when a beverage can is placed between the tabs in encircled relation, and the strips of Velcro are overlapped and pressed together, the can will be encircled in tight insulated relation. Moreover, the closed loops which are opened when the tabs are swung inwardly, provide adjacent handle elements by means of which the insulated can may be supported.

BRIEF DESCRIPTION OF THE DRAWINGS

It is an object of our invention to provide a very inexpensive but effective handled, open-ended single layer thermal insulator for beverage containers and a simple and inexpensive method of making same.

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
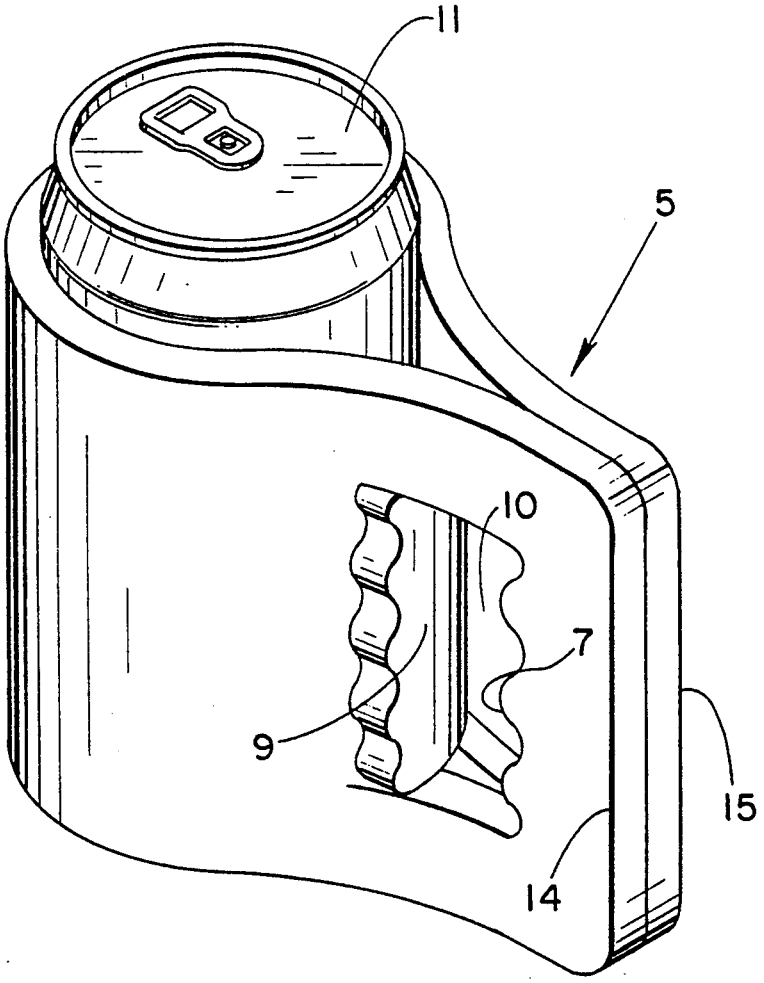
FIG. 1 is a perspective view of my thermal insulator wrapped in insulating position about the exterior of a can of beverage.
Figure 2:
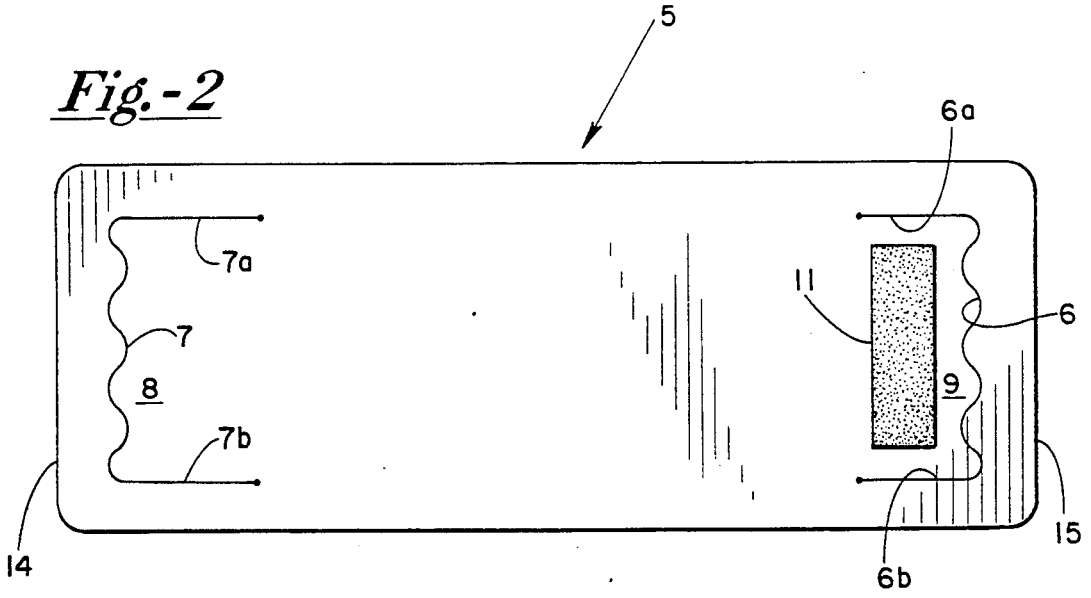
FIG. 2 is a plan view of one side of the flat panel which comprises my insulator-container.
Figure 3:
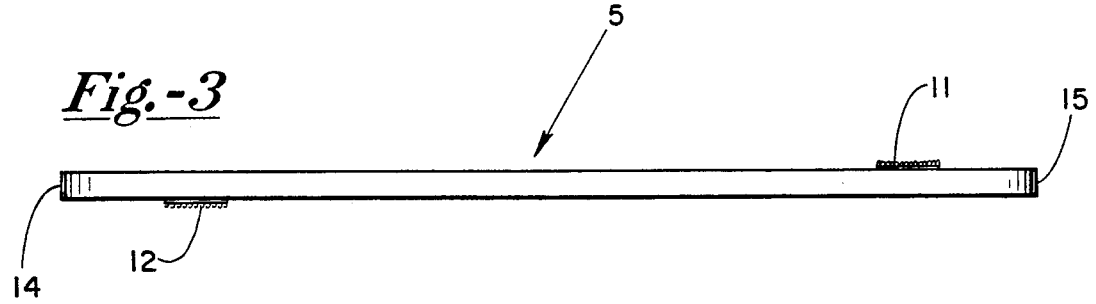
FIG. 3 is a side elevational view of the panel shown in FIG. 2.
Figure 4:
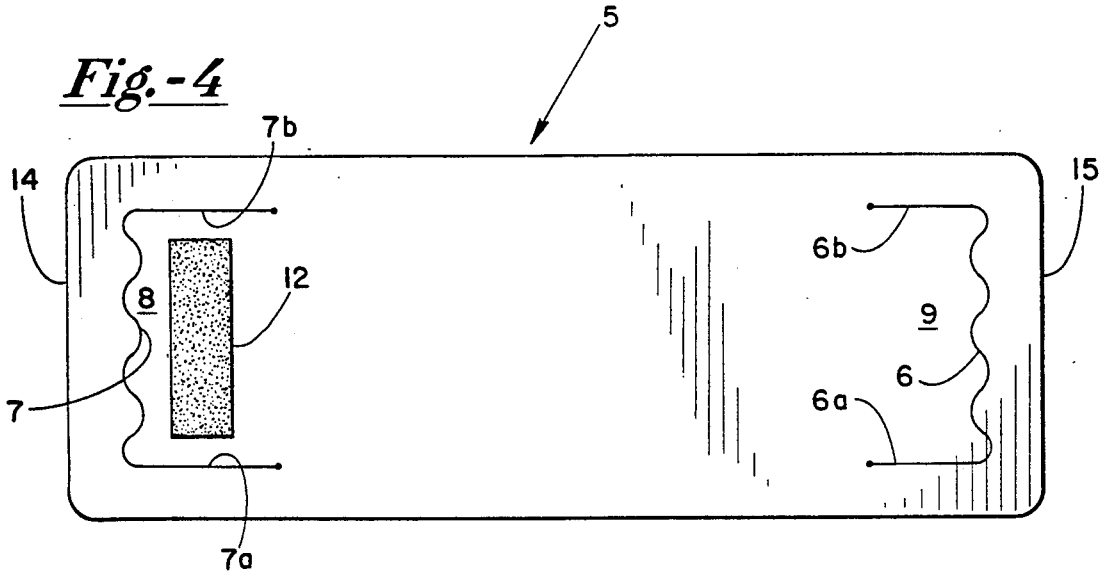
FIG. 4 is a plan view of the opposite side of the flat panel shown in FIG. 2.

The preferred embodiment of my invention is shown in FIGS. 1–4, inclusive. I make my insulator by selecting a flat panel of extruded foamed cross-linked polyolefin material (preferably irradiated cross-linked polyethylene) and cutting a generally rectangular strip 5 therefrom, as shown in FIGS. 2 and 4. This panel and strip of highly insulative material is approximately ⅜" thick throughout. At the same time, or shortly thereafter, I make two (2) generally U-shaped die-cuts 6 and 7 through the strip 5, one adjacent each end of the strip. As can be readily seen by reference to FIGS. 2 and 4, the two (2) generally U-shaped die-cuts 6 and 7 face toward each other and away from its adjacent end of the strip 5.

As shown in FIGS. 2 and 4, the legs **7*a* and 7*b* of the U-shaped cut 7 are approximately 40% longer than the corresponding legs 6*a* and 6*b* of the U-shaped cut 6. The length of the legs 7*a* and 7*b* are preferably about 1-⅜" long while the length of the shorter legs 6*a* and 6*b* are approximately 1" long. As shown, the length of the legs of the cuts 6 and 7 are approximately one half the length of the cut along the base of the U-cut. The overall length of the strip 5** is preferably approximately 12-¾".

The base of the cuts 6 and 7 are cut along wavey lines, as shown in FIGS. 2 and 4, to more readily accommodate and fit the finger portion of a users hand. As shown in FIGS. 2 and 4, the two (2) cuts 6 and 7 form free-swinging tabs 8 and 9, which can be readily swung out of the general plane of the strip 5, to thereby create an opening such as 10, as best shown in FIG. 1. At the same time, the more exterior portions of the strip 5 become closed loops which will function as handles when the strip has been applied to a beverage can in insulating relation, again as shown in FIG. 1.

To enable a user to apply my insulator to a can of beverage in thermal-insulating relation, I secure a strip 11 of Velcro with adhesive to one side of the tab 6 adjacent its free end. I also secure with adhesive a second strip 12 of cooperating Velcro to the opposite side of tab 7.

To apply my insulating strip 5 to a beverage can 13, I apply the end of the strip 5 having tab 8 to the can first, with the Velcro strip 12 facing outwardly away from the can. I then wrap the remainder of the strip tightly around the body of the can intermediate its ends and bring the tab 9 into overlapping and interlocking relation with tab 8 to thereby secure the strip 5 in encircling and insulating relation to the can 11. It will be appreciated that the insulator so formed is open-ended at the top and bottom.

It will also be seen, by reference to FIG. 1, that when tabs 8 and 9 are so brought into overlapping and interlocking relation, the respective end portions of the strip 5 abut and extend radially outwardly from the can as closed loops and function as cooperative handle elements 14 and 15.

When the can 11 has become empty and it is desired to replace same with a filled can, the user simply tears tab 9 free, whereupon strip 5 will immediately return to its original elongated flat form and can be similarly applied to the filled can in the same manner as shown in FIG. 1. Thus, it can be seen that my insulating jacket can be reused, over and over again. It will also be seen that the top of the can is readily accessible for drinking the contents of the can therefrom. Since the can projects slightly from the bottom of the jacket, the flat bottom of the can supports same and the insulator jacket upon any flat surface chosen to support same between drinks.

Since the strip 5 is made of foamed highly insulative material, it effectively insulates a can of chilled beverage, such as can 11, thus contributing to its drinkability over a longer period of time. As indicated above, when can 11 becomes empty, it is a simple matter to remove strip 5 therefrom and apply it to a different chilled full can.

The handle elements 14 and 15 which are inherently present as a result of the method by which I form and cut strip 5, provide ready means for grasping and elevating can 11 to facilitate drinking therefrom. As shown, the inner surfaces thereof are configured to conform to the finger portions of the human hand. Pressure relief is accomplished by small circular cuts made at the end of each leg of each U-shaped cut, thereby facilitating the bending of the tabs at their base. It also minimizes stress on the material at their base, which could cause a tear.

The longer legs *7a* and *7b* are provided in order to better accommodate the human hand, since the overlapping of that end of the strip 5 reduces the space available between the overlapped tabs and the handle elements 14 and 15.

One of the advantages of my new insulating jacket is that they may be inventoried in relatively very small compass while awaiting their sale. Another advantage is that, because of their small compass when not applied to a can, they can be kept handy for point of sale transactions i.e. immediately adjacent the cash register of the selling establishment.

The primary advantage, however, is the greatly reduced cost of manufacture and their effectiveness in providing a reusable and effective insulating medium with inherent handle members to facilitate drinking beverage from the can.

It will, of course, be understood that various changes may be made in the form, details, arrangement and proportions of the parts without departing from the scope of the invention which consists of the matter shown and described herein and set forth in the appended claims.

I claim:

1. A handled open-ended, single layer, elastic thermal insulator for a cylindrical beverage container comprising:

(a) a flat generally rectangularly-shaped strip of flexible, elastic, expanded thermal insulating material having opposite terminal portions;

(b) each of said terminal portions having a free-swinging tab section disposed inwardly of outer ends of said terminal portions and being swingable inwardly of a remainder of said terminal portions into over-lapping relation to each other;

(c) cooperative engagement means carried by each of said free-swinging tab sections in position to cooperatively inter-engage each other when said strip is placed in encircling relation to the container and said tab sections are so over-lapped to thereby secure said strip in close-enclosing relation to the container; and (d) the remainder of said terminal portions extending radially outwardly relative to said tab sections in the form of closed loops when said strip encircles the cylindrical container and said cooperative engagement means of said tab sections are so interengaged to thereby constitute handles for said strip to support the strip and the container so secured therewithin.

2. The structure defined in claim 1, wherein said flat strip is comprised of a foamed cross-linked polyolefin.

3. The structure defined in claim 1, wherein said strip is approximately ⅜ inch thick throughout.

4. The structure defined in claim 1, wherein said cooperative engagement means is comprised of cooperating strips of Velcro adhesively secured to opposite sides of said tab sections.

5. The structure defined in claim 1, wherein said flat strip is comprised of foamed irradiated cross-linked polyethylene.

* * * * *